United States Patent [19]

Bogard

[11] Patent Number: 4,557,326

[45] Date of Patent: Dec. 10, 1985

[54] WELL TOOL LOCKING APPARATUS

[75] Inventor: Edward L. Bogard, Houston, Tex.

[73] Assignee: Geosource Inc., Houston, Tex.

[21] Appl. No.: 690,171

[22] Filed: Jan. 10, 1985

Related U.S. Application Data

[63] Continuation of Ser. No. 576,410, Feb. 2, 1984, abandoned.

[51] Int. Cl.[4] ..... E21B 23/00

[52] U.S. Cl. ..... 166/212; 166/65.1; 166/104

[58] Field of Search ..... 166/65 R, 104, 120, 166/124, 212, 382

[56] References Cited

U.S. PATENT DOCUMENTS

| | | | |
|---|---|---|---|
| 3,338,317 | 8/1967 | Shore | 166/63 |
| 3,661,205 | 5/1972 | Belorgey | 166/65 R |
| 4,243,099 | 1/1981 | Rodgers, Jr. | 166/65 R |
| 4,428,422 | 1/1984 | Laurent | 166/212 |

*Primary Examiner*—Stephen J. Novosad

*Assistant Examiner*—William P. Neuder

*Attorney, Agent, or Firm*—Arnold, White & Durkee

[57] ABSTRACT

A clamping apparatus for locking tools in a well is disclosed. A first piston sealably engages a hollow body member to form a chamber, which is filled with a working fluid. A bias member or spring moves the first piston, extending a clamping arm connected to the first piston against the well wall. A second piston is sealably engaged in a bore in the first piston; the bore is in fluid communication with the chamber. The second piston is driven into the bore by a motor, increasing the pressure in the chamber through a passage in the first piston between the bore and the chamber. This increased pressure further urges the first piston and locks the clamping arm against the well wall. The hydraulic pressure is released, and the clamping arm is unlocked, by opening a valve in a line between the chamber and a reservoir. The clamping arm is retracted by driving the second piston into the bore into contact with the first piston, forcing the first piston back against the spring.

10 Claims, 2 Drawing Figures

Fig. 1
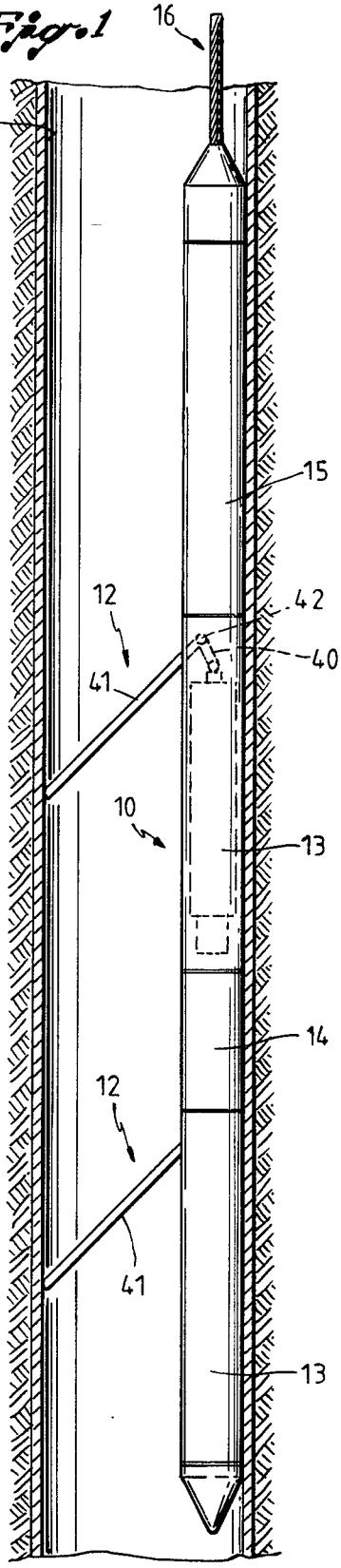
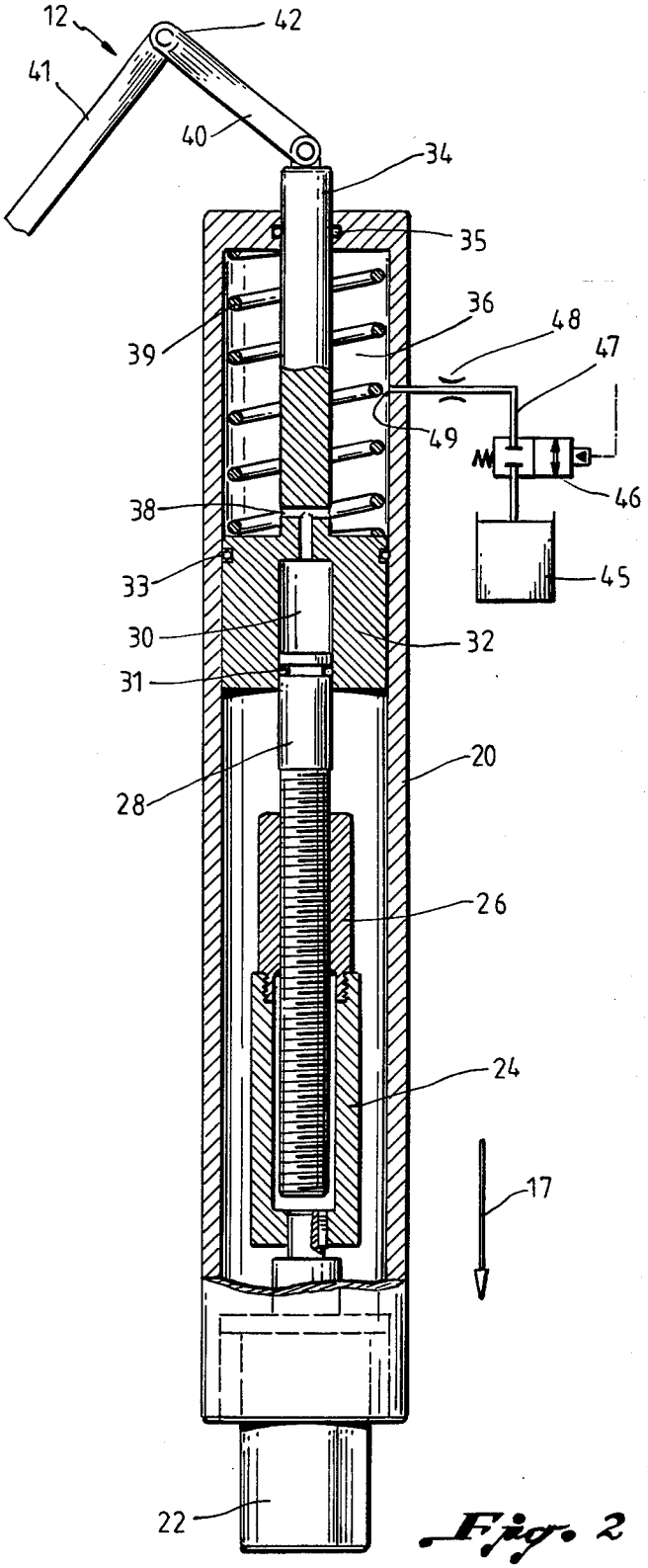
Fig. 2

WELL TOOL LOCKING APPARATUS

This is a continuation of application Ser. No. 576,410, filed Feb. 2, 1984 now abandoned.

BACKGROUND OF THE INVENTION

This invention relates to a clamping apparatus for locking a tool against the interior walls of a well, chimney, or similar conduit structure.

Tools of various kinds are frequently lowered into oil and gas wells. A tool often carries one or more instrument packages configured to provide data about a well. Precise measurement of these data often requires that the instruments be rigidly held in a fixed position relative to the well. Sometimes, as in the case of geophones used to obtain a seismic survey of a geological formation, the instruments must be rigidly held against the casing walls of the well to achieve optimum seismic coupling between the instruments and the formation.

Many prior locking devices relied on the weight of the tool components to provide locking force. Some seismic survey techniques, however, and particularly some recently developed techniques, call for a tighter lock against the casing wall than can be provided by tool weight alone. A locking force of three to four times that of the tool weight is often desirable.

A simple way of generating a locking force, and one very commonly used in the art, is to directly couple a motor and a spring to a clamping arm. This approach is limited by the force that can be generated by the motor and by the time required for motor movement in locking and unlocking the tool.

The time limitation can be particularly significant when the tool must be lowered to a series of positions in the well to obtain a profile of the geological formation. The locking and unlocking operations can slow down completion of the profile and add to the cost of exploration.

SUMMARY OF THE INVENTION

The present invention provides a clamping apparatus. A first piston is movably fitted inside a hollow body member to form a chamber, which is filled with a working fluid. The chamber is in fluid communication with an inflatable reservoir member, with a valving assembly interposed to regulate the fluid communication when appropriate during operation of the invention.

A reversibly extendable clamping arm is connected to the first piston so that motion of the first piston in a direction that expands the chamber urges the clamping arm against the well casing wall. A bias member is provided that engages the first piston and urges it in a direction resulting in such expansion of the chamber and thus urges the clamping arm into contact with the casing wall.

The first piston has a bore formed therein opening away from the chamber and filled with the working fluid. A passage in the first piston permits fluid communication between the bore and the chamber. A second piston is movably fitted in the bore. The second piston is reciprocated by a driver.

Motion of the second piston into the bore, with the valving assembly closed to isolate the chamber from the reservoir member, increases the fluid pressure in the bore and thus in the chamber. This increased pressure further urges the first piston in a direction tending to expand the chamber and thus further urges the clamping arm against the casing wall, tending to lock the clamping arm in place. Further motion of the second piston into the bore, this time with the valving assembly open to reduce the pressure in the chamber and thus reduce the clamping force, brings the second piston into contact with the first piston and urges the first piston in a direction tending to retract the clamping arm from the casing wall.

BRIEF DESCRIPTION OF THE DRAWINGS

FIG. 1 is a schematic representation of the preferred embodiment of the present invention.

FIG. 2 is a schematic representation of the preferred embodiment as it might be adapted for use in a vertical seismic profile tool. Throughout the following detailed description, similar reference numerals refer to similar elements in all Figures of the drawings.

DETAILED DESCRIPTION OF THE INVENTION

Referring to FIGS. 1 and 2, a typical well tool 10 is shown positioned in a well between casing walls 11. The tool 10 is held against the casing walls 11 by the action of one or more clamping arms 12. Each clamping arm 12 is brought into contact with the casing wall 11 by the action of a corresponding clamping apparatus 13 embodying the present invention and features one or more suitable contact assemblies (e.g., assemblies of tungsten carbide buttons) fashioned in a manner well known to those skilled in the art. For purposes of illustration the tool 10 is shown as including a sensor module 14 and an electronics module 15. It may be "lowered" and "raised" by means of a cable assembly 16. (The direction indicated by an arrow 17 is described herein as "down," and motion is described as "upward," "downward," and so forth, solely to provide a convenient frame of reference for a description of the preferred embodiment of the present invention. In other embodiments the arrow 17 and the directions described herein may refer to other directions.)

The cable assembly 16 may contain power, control, and instrumentation lines for the clamping apparatus 13 and the sensor and electronics modules 14 and 15. Those skilled in the art having the benefit of this disclosure will recognize that these lines may be arranged in any number of ways to provide convenient control of the operation of the invention as described below. It will also be apparent to those skilled in the art that the clamping apparatus 13 and the present invention embodied therein are adaptable to many other equipment configurations for use in well services and elsewhere.

A first piston 32 drives the clamping arm 12 against the casing wall 11 when the first piston 32 is moved downward and retracts it from the casing wall 11 when the first piston 32 is moved upward. In the preferred embodiment of the invention this is achieved by articulating the clamping arm 12 into an intermediate segment 40 (attached to an extension 34 of the first piston 32) and a downward-extending clamping segment 41 (to be urged against the casing wall 11) joined by a pivot 42 anchored by suitable means relative to the clamping apparatus 13. As will be apparent from FIGS. 1 and 2, the weight of the tool 10 thus contributes to the net force holding the clamping arm 12 against the casing wall 11.

The first piston 32, which may be fitted with one or more O-rings 33, sealably engages a cylinder-like hollow body member 20 to form a chamber 36. The chamber 36 is filled with a working fluid such as hydraulic fluid. In the preferred embodiment shown, the extension 34 of the first piston 32 penetrates the body member 20, which may be fitted with O-rings 35 at the point of this penetration for a better seal.

The working fluid is kept under a suitable hydrostatic head from an inflatable reservoir member 45. As will be apparent to those skilled in the art, this head may be generated using a bellows assembly or other suitable device. The reservoir 45, if located external to the body member 20 (as shown in the preferred embodiment), may be connected to the body member 20 through a fluid line 47 at a penetration point 49.

A valving assembly is interposed in the fluid line 47 to restrict fluid communication between the chamber 36 and the reservoir 45. In the preferred embodiment the valving assembly comprises a normally-open solenoid-operated valve 46 and an orifice plate 48; as is discussed below, this arrangement provides certain safety features in the operation of the invention.

A passage 38 (shown as being formed in the extension 34) permits fluid communication between the chamber 36 and a bore 30, also filled with the working fluid, in the first piston 32. The bore 30 may (but, as will be apparent to those skilled in the art, need not) be circular in shape. An upper end of a second piston 28 is sealably fitted into the bore 30, using O-rings 31 for a better seal if desired.

The second piston 28 is connected to a reciprocating apparatus which moves the second piston 28 up and down as desired. In the preferred embodiment the lower end of the second piston 28, formed as a ball screw, engages a ball nut 26. The ball nut 26 is rotably coupled to a reversible motor (in the preferred embodiment, a reversible direct-current electric motor) 22 by a coupling 24.

A bias member, such as a spring 39, is adapted to urge the first piston 32 in a downward direction. In the preferred embodiment the spring 32 is adapted to be interior of the chamber 36.

The operation cycle of the present invention may be usefully illustrated by considering a typical insertion of the tool 10 into a cased well.

In brief, the clamping apparatus 13 may be initially in a random position in which the clamping arm 12 is partially or fully extended. The clamping arm 12 is retracted, the tool 10 is lowered to the lowest desired depth in the well, and the clamping arm 12 is extended into initial, low-pressure contact with the casing wall 11. The clamping arm 12 is then urged against the casing wall 11 with greater force to lock the tool 10 tightly against the casing wall 11. Seismic observations can then be made at that depth. When the tool 10 is to be moved, the clamping force is removed, leaving the clamping arm 12 in its original low-pressure contact with the casing wall 11. The tool 10 can then be raised, "dragging" the clamping arm 12 against the casing wall 11, until a new desired depth is reached, whereupon the tool 10 can be relocked against the casing wall 11 as before and additional seismic observations made.

Considering the operating cycle now in more detail, the clamping apparatus 13 is initially brought to its "retracted" position by opening the valve 46 and operating the motor 22 to move the second piston 28 up. The working fluid in the bore 30 is forced through the passage 38 into the chamber 36 by the second piston 28's upward motion; working fluid in the chamber 36 in turn flows into the reservoir 45. The second piston 28 eventually contacts the first piston 32 and urges it upward (compressing the spring 39). This upward motion, transmitted through the first piston extension 34 to the intermediate segment 40, causes the clamping segment 41 to pivot downward and inward about the pivot 42 toward the retracted position. The tool 10 may then be inserted into the well.

Once the tool 10 is at the lowest desired depth in the well, the clamping segment 12 is brought into initial contact with the casing wall 11. To achieve this, the motor 22 is operated to pull the second piston 28 down from its contact with the first piston 32. No longer held up by the second piston 28, the first piston 32 is pushed downward by the spring 39. The intermediate segment 40 is pulled downward by the extension 34; the clamping segment 41 pivots upward and outward about the pivot 42 and into contact with the casing wall 11. At the same time working fluid flows into the bore 30 under the head provided by the reservoir 45.

The tool 10 is locked more tightly against the casing wall 11 by increasing the outward force on the clamping arm 12. This is begun by closing the valve 46, isolating the chamber 36 from the reservoir 45. The motor 22 is then operated to drive the second piston 28 upward, increasing the working fluid pressure in the bore 30 and thus in the chamber 36. The increased pressure in the chamber 36 tends to drive the first piston 32 down, pulling the extention 34 down and locking the clamping arm 12 against the casing wall 11 in the same manner described above but with greater force than was achieved by the spring 39 alone.

The tool 10 may be unlocked by opening the valve 46, thus lowering the working fluid pressure in the chamber 36 and reducing the force holding the clamping arm 12 against the casing wall 11. The tool 10 can then be raised as desired, "dragging" the clamping arm 12 against the casing wall 11. Those skilled in the art having the benefit of this disclosure can easily calculate the optimum strength of the spring 39 (or other bias) so that, with the valve 46 open, the clamping arm 12 is just held against the casing wall 11 to permit this dragging.

It will be appreciated that locking and unlocking the tool are relatively quick operations. This is particularly advantageous when the tool 10 is configured to carry seismic profiling equipment: the tool 10 can be quickly repositioned, permitting a series of seismic observations to be made in a relatively short time.

On the other hand, for safety reasons it is not desirable for the initial extension of the clamping arm 12 by the spring 39 to be particularly fast, particularly when the tool 10 is not in a well. Toward that end, the orifice plate 48 in the valving assembly restricts the flow of working fluid into the chamber 36 and thus the speed at which the first piston 32 can initially move downward. Those skilled in the art having the benefit of this disclosure will recognize that the valve 46 and the orifice plate 48 could be replaced by a single (but possibly more complex and expensive) flow control valve to achieve this result.

An additional safety feature lies in the fail-open nature of the valve 46. If power to the clamping apparatus 13 is lost, the valve 46 opens, relieving the hydraulic pressure in the chamber 36. This unlocks the tool 10 from the casing wall 11 and permits it to be extracted from the well.

A further advantage of this invention with respect to extraction from the well arises from the arrangement of the clamping segment 41 and the pivot 42. If the clamping segment 41 encounters an obstacle during extraction, it simply pivots downward about the pivot 42 and passes over the obstacle.

It will be appreciated by those skilled in the art having the benefit of this disclosure that this invention is believed to be capable of application in other situations. Accordingly, this description is to be construed as illustrative only and as for the purpose of teaching those skilled in the art the manner of carrying out the invention.

It is also to be understood that the form of the invention shown and described is to be taken as the presently preferred embodiment. Various changes may be made in the shape, size, and arrangement of parts without departing from the spirit and scope of the invention as set forth below in the claims.

What is claimed is:

1. Clamping apparatus for use in a conduit comprising:

a hollow body member;

a first piston movably fitted within said hollow body member to form a chamber, said chamber being filled with a working fluid;

said first piston having a bore formed therein opening away from said chamber and filled with said working fluid; and said first piston having a passage formed therein to permit fluid communication between said bore and said chamber;

a reversibly extendable clamping arm connected to said first piston so that motion of said first piston in a direction that expands said chamber urges said clamping arm away from said clamping apparatus;

a bias member engaging said first piston and configured to expand said chamber;

a second piston movably fitted within said bore in said first piston;

a driver configured to reciprocate said second piston;

an inflatable reservoir member in fluid communication with said chamber; and a valving assembly operable to regulate fluid communication between said reservoir and said chamber.

2. The clamping apparatus of claim 1 wherein said driver comprises:

a ball screw connected to said second piston;

a ball nut rotably engaging said ball screw;

a motor configured to reversibly rotate said ball nut.

3. The clamping apparatus of claim 1 wherein said bias member comprises a spring.

4. The clamping apparatus of claim 1 wherein said clamping arm comprises an intermediate segment connected to said first piston;

a downward-extending clamping segment; and a pivot anchored with respect to said clamping apparatus and connecting said intermediate segment to said clamping segment.

5. The clamping apparatus of claim 1 wherein said valving assembly comprises a solenoid-operated valving apparatus.

6. The clamping apparatus of claim 1 wherein said valving assembly comprises an orifice plate.

7. A clamping apparatus for use in a conduit comprising:

a hollow body member;

a first piston movably fitted within said hollow body member to form a chamber, said chamber being filled with a working fluid;

said first piston having a bore formed therein opening away from said chamber and filled with said working fluid; and said first piston having a passage formed therein to permit fluid communication between said bore and said chamber;

a reversibly extendable clamping arm comprising an intermediate segment connected to said first piston;

a clamping segment; and a pivot anchored with respect to said clamping apparatus and connecting said intermediate segment to said clamping segment;

a spring engaging said first piston and configured to expand said chamber;

a second piston movably fitted within said bore in said first piston;

a ball screw connected to said second piston;

a ball nut rotably engaging said ball screw;

a motor configured to reversibly rotate said ball nut;

an inflatable reservoir member in fluid communication with said chamber; and a solenoid-operated valving apparatus and an orifice plate each configured to regulate fluid communication between said reservoir and said chamber.

8. The clamping apparatus of claim 7 wherein said motor comprises an electric motor.

9. The clamping apparatus of claim 7 wherein said spring is mounted interior to said chamber.

10. A clamping apparatus for use in a conduit comprising:

a hollow body member;

a first piston movably fitted within said hollow body member to form a chamber, said chamber being filled with a working fluid;

said first piston having a bore formed therein opening away from said chamber and filled with said working fluid; and said first piston having a passage formed therein to permit fluid communication between said bore and said chamber;

a reversibly extendable clamping arm comprising an intermediate segment connected to said first piston;

a clamping segment; and a pivot anchored with respect to said clamping apparatus and connecting said intermediate segment to said clamping segment;

a spring adapted within, and configured to expand, said chamber;

a second piston movably fitted within said bore in said first piston;

a ball screw connected to said second piston;

a ball nut rotably engaging said ball screw;

an electric motor configured to reversibly rotate said ball nut;

an inflatable reservoir member in fluid communication with said chamber; and a solenoid-operated valving apparatus and an orifice plate each configured to regulate fluid communication between said reservoir and said chamber.

* * * * *